US006497469B1

(12) United States Patent
Shinada et al.

(10) Patent No.: US 6,497,469 B1
(45) Date of Patent: Dec. 24, 2002

(54) PRINT SYSTEM, INK JET PRINTER AND INK CARTRIDGE

(75) Inventors: Satoshi Shinada, Nagano (JP); Kazuhiro Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/652,657

(22) Filed: Aug. 31, 2000

(30) Foreign Application Priority Data

Aug. 31, 1999 (JP) ..... 11-244276
Oct. 15, 1999 (JP) ..... 11-293616

(51) Int. Cl.[7] ..... B41J 2/01
(52) U.S. Cl. ..... 347/19; 347/7
(58) Field of Search ..... 347/7, 19, 49, 347/85, 67; 399/12, 24, 27

(56) References Cited

U.S. PATENT DOCUMENTS 5,049,898 A 9/1991 Arthur et al. ..... 346/1.1
5,365,312 A * 11/1994 Hillmann et al. ..... 399/12
5,428,378 A 6/1995 Murata et al. ..... 347/19
5,802,420 A 9/1998 Garr et al. ..... 399/27
6,019,461 A * 2/2000 Yoshimura et al. ..... 347/86

FOREIGN PATENT DOCUMENTS

JP 3-278963 12/1991 ..... B41J/2/175
JP 4-33866 2/1992 ..... B41J/2/175
WO 98/52762 11/1998 ..... B41J/2/01

* cited by examiner

*Primary Examiner*—Craig Hallacher
(74) *Attorney, Agent, or Firm*—Sughrue Mion, PLLC

(57) ABSTRACT

An ink jet printer has an ink jet record head, an ink cartridge for supplying ink to the ink jet record head, the ink cartridge having a semiconductor storage system storing at least the data defining the effectively usable period since the ink cartridge was placed in the printer, and a control system consisting of a CPU, RAM, and ROM for controlling the ink jet record head in response to print data. The control system calculates the effectively usable period based on the elapsed time since the ink cartridge was placed in the printer and the effectively usable a period and updates the effectively usable period stored in the storage system.

52 Claims, 12 Drawing Sheets

PRINTER PROCESSING IN CASE OF CARTRIDGE PLACEMENT

PRINT SYSTEM, INK JET PRINTER AND INK CARTRIDGE

BACKGROUND OF THE INVENTION

This invention relates to a print system, an ink jet printer and a cartridge, and in particular to a technology for managing a cartridge.

An ink cartridge is installed in a printer to supply ink via a line to an ink jet record head. A brand-new ink cartridge is contained in a highly airtight bag or a sealed container. In a state in which the ink cartridge is placed in the printer, an ink solvent evaporates through an atmospheric open hole for aiding the flowing-out of ink, a container made of a polymeric material forming a part of the ink cartridge, the line, the record head, etc., and the viscosity of ink rises with time, hindering the record operation.

Accordingly, it is important to manage the ink cartridge based on a time period for which the ink cartridge is placed in the printer.

JP-A-4-33866 and JP-A-3-278963 propose the following: A microcomputer having a timer function is attached to an ink cartridge, and if the elapsed time since the ink cartridge was placed in a printer exceeds the effectively usable time, a warning is indicated.

SUMMARY OF THE INVENTION

It is an object of the present invention to provide a printer, a printer system and/or an ink cartridge used with the printer and/or the printer system, by which data management regarding the use of the ink cartridge can be conducted more positively.

It is another object of the invention to provide a printer, a printer system and/or an ink cartridge used with the printer and/or the printer system, by which an effectively usable period of the ink cartridge can be managed without complicating the structure of the ink cartridge.

It is yet another object of the present invention is to provide a printer, a printer system and/or an ink cartridge used with the printer and/or the printer system, by which an effectively usable period of the ink cartridge can be correctly managed even if the ink cartridge is used with a plurality of different printers.

According to a first aspect of the present invention, a timer system provided in a printer or a host device connected to the printer is used to manage the ink cartridge.

According to a second aspect of the present invention, data concerning management of an ink cartridge are modified depending on the use of the ink cartridge.

According to a third aspect of the present invention, data concerning management of an ink cartridge are stored in a data storage system provided in the ink cartridge.

The present invention provides, for example, an ink jet printer comprising an ink jet record head, an ink cartridge for supplying ink to the ink jet record head, the ink cartridge to which a writable or rewritable storage system storing effectively usable period information defining an effectively usable period since the ink cartridge was placed in the printer or a printer is attached, and a control system for controlling the ink jet record head in response to print data. The control system calculates the effectively usable period based on the elapsed time since the ink cartridge was placed in the printer and the effectively usable period, and updates the effective usable period stored in the storage system.

Since the effective usable period is simply stored in the storage system, a timing microcomputer and power supply become unnecessary.

The present invention further provides, for example, the following: A time period data recording system and a time period expiration determining system are provided in a printer or a host device. The time period recording system calculates a time period or a time length for which an ink cartridge is placed in the printer, and records data relating to the time period or time length in a storage medium mounted on the ink cartridge. The time period expiration determining system recognizes an elapsed time period from a time point at which the brand-new ink cartridge is initially placed in the printer or a printer, or a time point at which a package for the brand-new ink cartridge is broken or opened, based on data recorded in the storage medium of the ink cartridge, and determines whether or not an effectively usable period expires based on the elapsed time period.

With this technology, even if the ink cartridge is used with a plurality of printers, or even if absolute date and time setting is different timer by timer, the elapsed time period can be recognized as a summed-up value of the time periods for which the ink cartridge is placed in respective printers, and consequently the determination can be made as to whether or not the effectively usable period expires.

In a preferred embodiment, the time period data recording system and the time period expiration determining system are provided to the printer, but these systems may be provided to the host device. The function of each of these systems may be dividingly distributed to and cooperatively executed by the printer and the host device.

In the preferred embodiment, the time period data recording system adds the time period for which the ink cartridge is placed in the printer to the previous elapsed time period stored in the recording medium of the ink cartridge to obtain a new elapsed time period, and records the new elapsed time period in the recording medium of the cartridge again. The time period expiration determining system reads this new elapsed time period from the recording medium of the cartridge, and determines whether or not the effectively usable time period expires based on this new elapsed time period.

In the preferred embodiment, the printer has a timer activated continuously regardless of whether power for the printer is turned on or off, a second storage medium, and a controller for controlling operation of the printer. This controller serves as the time period data recording system and the time period expiration determining system. That is, the controller performs the following operations 1) to 6):

1) When the ink cartridge is newly placed in the printer, that is, immediately after the ink cartridge replacement, the placement date and time is obtained from the timer, and recorded into the storage medium provided in the printer.
2) Periodically, or at the time of turning off the power or immediately before the ink cartridge is replaced, a time difference between a current date and time obtained from the timer and the placement date and time recorded in the storage medium in the printer is calculated.
3) This time difference is added to the elapsed time period already recorded in the storage medium of the cartridge.
4) The elapsed time period obtained by this addition is over-written on the storage medium of the cartridge.
5) Immediately after the ink cartridge replacement, periodically, immediately after the power turning on, or immediately before the start of print, the elapsed time period is read from the storage medium of the ink cartridge, and whether or not the effectively usable time period expires is checked.

6) If the effectively usable time period expires, this fact is informed to the user through a user interface of the printer or a host device.

The present disclosure relates to the subject matter contained in Japanese patent application Nos. Hei. 11-244276 (filed on Aug. 31, 1999) and Hei. 11-293616 (filed on Oct. 15, 1999), which are expressly incorporated herein by reference in their entireties.

DESCRIPTION OF THE PREFERRED EMBODIMENT

Figure 1:
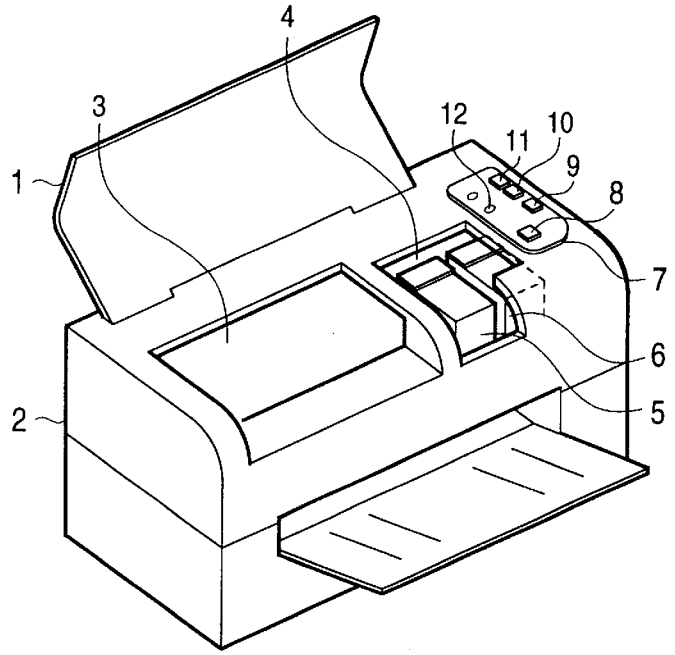
FIG. 1 is a drawing to show one embodiment of an ink jet printer of the invention.

Preferred embodiments of the present invention will be described with reference to the accompanying drawings FIG. 1 shows an embodiment of an ink jet printer of the invention. The ink jet printer comprises a print mechanism (described later) housed in a case. The case is made up of a case cover 1 that can be opened and closed and a case main body 2. The case main body 2 is formed with a window 4 for partitioning a cartridge replacement area at a position at a distance from a print area 3.

The window 4 is sized so as to expose all the top face of only one of two ink cartridges 5 and 6 mounted on a carriage. An operation panel 7 is placed in an area where the main body case 2 is exposed when the case cover 1 is closed. A power switch 8, a cartridge replacement command switch 9, a cleaning command switch 10, a continuation command switch 11, and a display 12 are placed on the operation panel 7.

Figure 2:
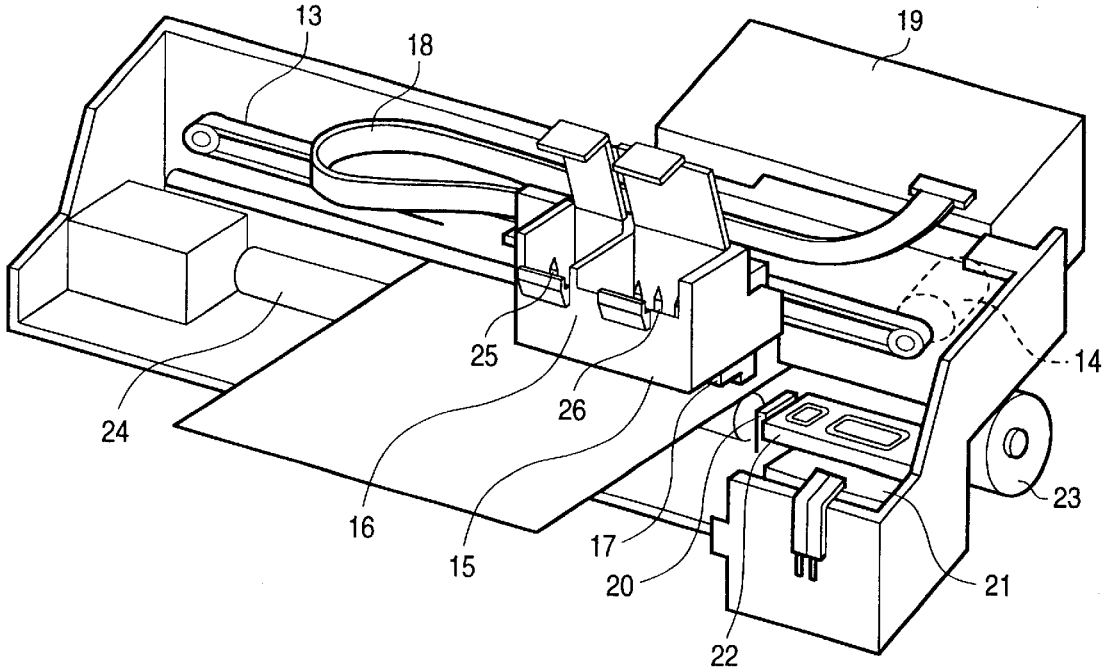
FIG. 2 is a drawing to show a print mechanism of the ink jet printer in FIG. 1.

FIG. 2 shows an example of a print mechanism installed in the ink jet printer shown in FIG. 1. A carriage 15 is connected to a drive motor 14 by a timing belt 13. The carriage 15 is formed on an upper face thereof with a holder 16 for holding a black ink cartridge 5 storing black ink and a color ink cartridge 6 storing color ink. The carriage 15 is provided on a lower face thereof with a record head 17 for receiving supply of ink from the ink cartridges 5 and 6.

The carriage 15 is connected to a controller 19 (described later) by a flexible cable 18, so that the controller 19 can supply a print signal to the print head 17 and communicate with a storage system 53 of the ink cartridge 5, 6.

Provided in a non-print area are a cleaning blade 20 for cleaning the record head 17 and a capping system 22 for sealing the record head 17 to prevent ink from being dried and receiving supply of a negative pressure from a pump unit 21 to eliminate clogging. In FIG. 2, numeral 23 denotes a paper feed motor for driving a paper feed roller 24 and the pump unit 21.

Figure 3A:
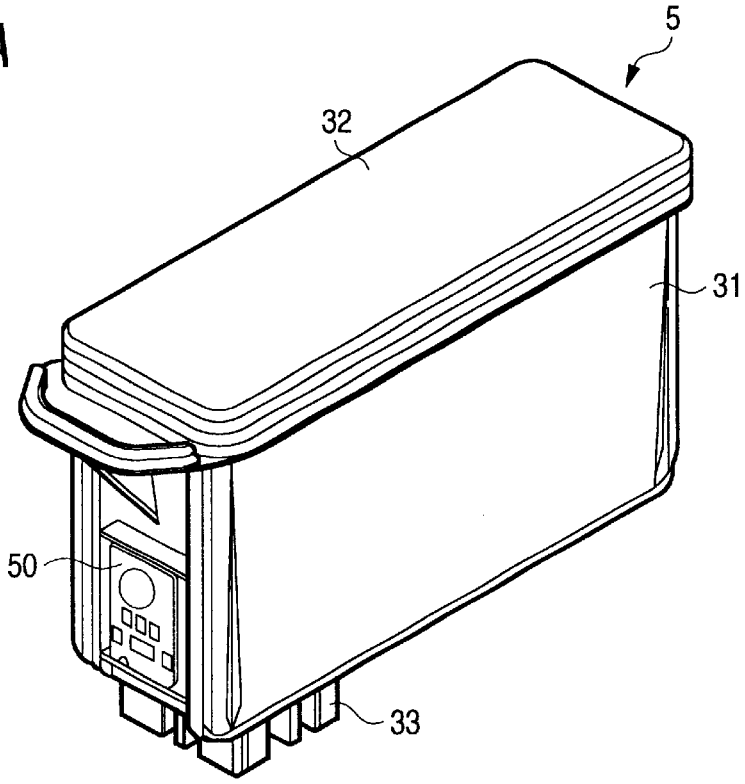
FIGS. 3A and 3B are drawings to show one embodiment of a black ink cartridge and one embodiment of a color ink cartridge used with the ink jet printer in FIG. 1.
Figure 3B:
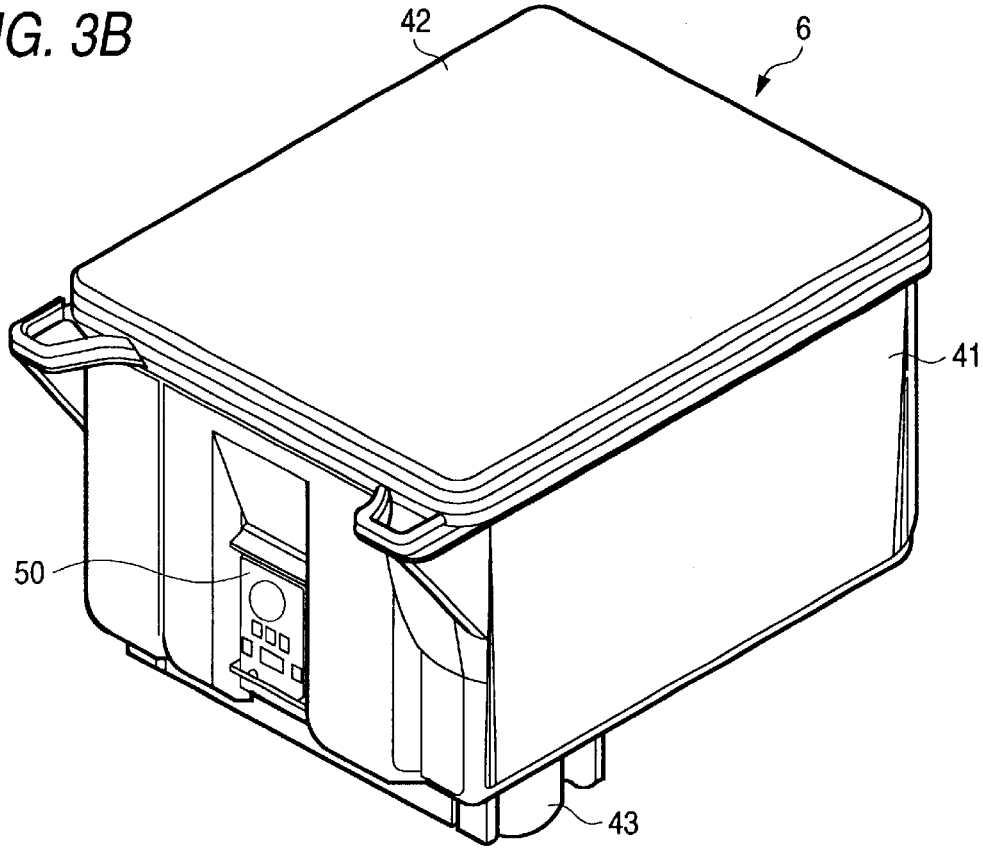

FIGS. 3A and 3B respectively show an example of the black ink cartridge 5 and an example of the color ink cartridge 6. Ink. is stored in a container 31, 41, and the top face of the container 31, 41 is sealed with a lid 32, 42. Ink is stored in a state in which the container 31, 41 is filled with a porous member, which is impregnated with the ink.

The container 31, 41 is formed on a bottom face thereof with an ink supply port 33, 43 air-tightly engaging an ink supply needle 25, 26 when the ink cartridge is placed in the holder 16 of the carriage 11. A circuit board 50 is fixed onto one side surface of the container 31, 41.

Figure 4A:
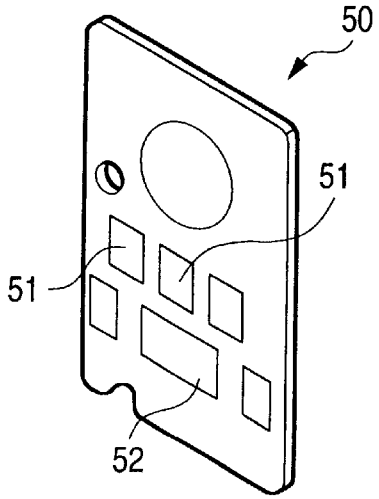
FIGS. 4A and 4B are drawings to show the surface and back structures of a circuit board attached to the ink cartridge in FIG. 3.
Figure 4B:
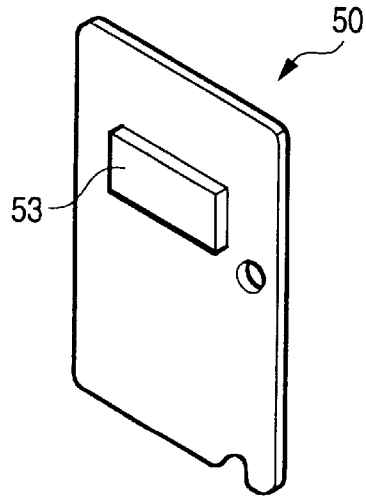
Figure 5:
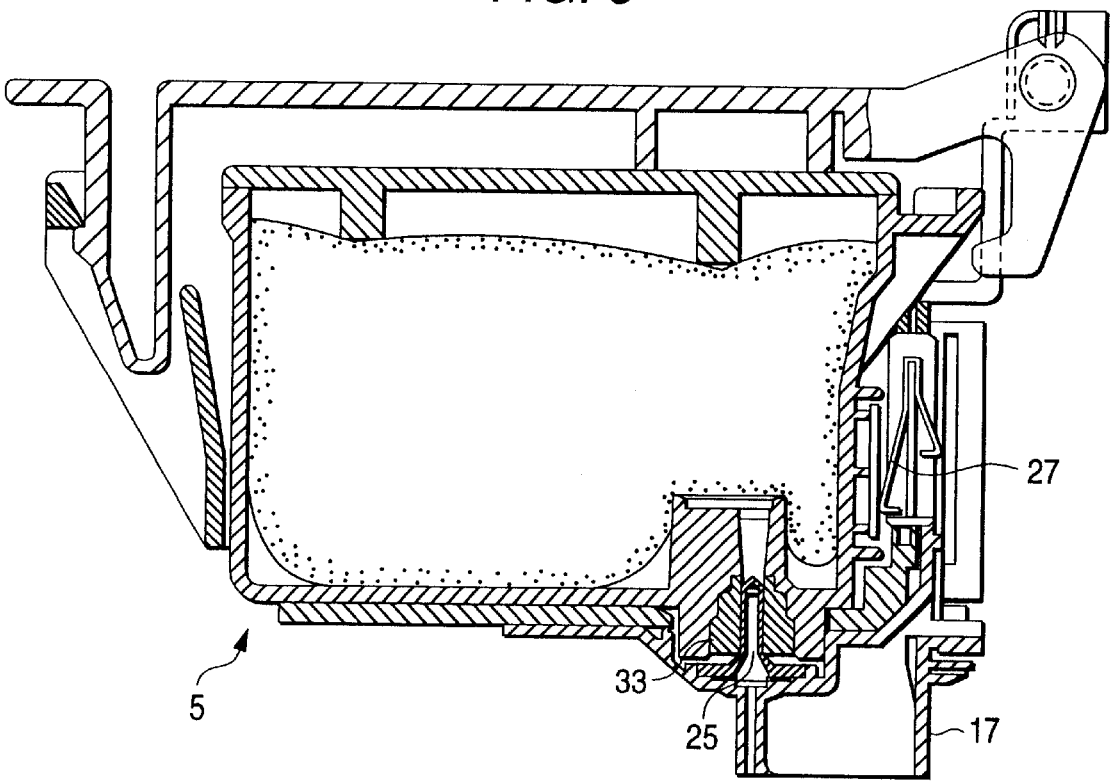
FIG. 5 is a sectional view of the ink jet printer with the black ink cartridge placed therein.

FIGS. 4A and 4B respectively show a surface side of the circuit board 50 when the circuit board 50 is attached to the ink cartridge 5, 6, and a back side opposite from the surface side. The circuit board 50 is formed on the surface side thereof with electrodes 51 and 52 forming contacts with a contact 27 (FIG. 5) formed on the cartridge holder 12 of the printer. The circuit board 50 is provided on the back side thereof with a semiconductor storage system 53 in an accessible fashion.

The semiconductor storage system 53 is constructed by an electrically writable or rewritable nonvolatile memory. In addition to the serial number for identifying the ink cartridge 5, 6, the amount of ink stored in the ink cartridge 5, 6, the model of the ink cartridge 5, 6, and the trademark for clarifying the source of the product, effectively usable period information is previously written in the storage system 53 at factory shipment. The effectively usable period information contains, for example, information defining a-time period or time length from a time point at which a brand-new ink cartridge 5, 6 is initially placed in a printer or a time point at which a package for a brand-new ink cartridge 5, 6 is opened or broken up to a time point at which the ink cartridge cannot be used effectively.

As the effectively usable period information, for example, the storage system 53 stores a maximum time period for which the ink cartridge 5, 6 can be used with a printer, and if the maximum time period becomes zero, then it is determined that the effectively usable period of the ink cartridge 5, 6 expires. In a specific example, a period of six months is initially stored as the effectively usable period information, and depending on an elapsed time period (for example, one month) for which the ink cartridge is placed in the printer, a remaining time period (in this case, five months) is stored in the storage system as the effectively usable period information.

It is also conceivable that the maximum time period is fixed, That is, for example, an elapsed time period for which the ink cartridge is placed in a printer is transferred from the printer and stored in the storage system of the ink cartridge, and when the ink cartridge is mounted to the printer, the elapsed time period stored in the in the storage system of the ink cartridge is compared with a maximum value of the effectively usable period to determine whether or not the effectively usable period expires.

Further, it is also conceivable that a time point (date and time) at which the ink cartridge in a brand-new state is initially mounted is stored in the storage system of the ink cartridge, and whether or not the effectively usable period expires is determined by a printer using this information. In this case, the initially mounted time point is stored in the storage system of the ink cartridge, but alternatively an expiration time point (expiration date and time) at which the effectively usable period expires may be calculated by a printer based on the initially mounted time point, and stored in the storage system of the ink cartridge so as to enable comparison between the expiration time point and a current time point to thereby determine whether or not the effectively usable period expires.

The period for which the quality of the ink cartridge 5, 6, the function of the ink cartridge 5, 6, etc. are maintained vary depending on an ambient condition where the ink cartridge 5, 6 is used, and for this reason, the effective usable period or the expiration time point varies depending on the ambient condition. Therefore, the effectively usable period information may be constructed by plural pieces of information indicating a relationship between the ambient condition in which the printer is installed, and the time period, or may be modified depending on the ambient condition. As the ambient condition, for example, temperature can be used.

For example, Table 1 can be used to calculate the effectively usable period or the expiration time point of the effectively usable period based on an average ambient temperature for a predetermined time period. In the table 1, the column "Ambient temperature" indicates a temperature range to which the average ambient temperature for the predetermined time period belongs and the column "Effective time limit" indicates a coefficient used to adjust the elapsed time period based on the average temperature to calculate or modify the effectively usable period.

TABLE 1

| Ambient temperature | Effective time limit |
|---|---|
| T1–T2 | L1 |
| T2–T3 | L2 |
| T3–T4 | L3 |
| T4–T5 | L4 |

The table 1 is used, for example, as follows:

If the average ambient temperature for the predetermined time period (for example, one month) falls within the temperature range from T1 to T2, then the predetermined time period (one month) is multiplied by the coefficient L1 (for example, set to be "0.5") to obtain a modified elapsed time period (in this case, 0.5 month). Then, the modified elapsed time period (0.5 month) is subtracted from the effectively usable time period (for example; 6 months) stored in the storage system to obtain the effectively usable period (in this case, 5.5 months) modified depending on the ambient temperature condition. The modified effectively usable period (5.5 months) can be stored in the storage system of the ink cartridge as updated effectively usable period.

The similar processing as that described above can be applied to calculation of the expiration time point of the effectively usable period.

When a brand-new ink cartridge 5,6 is initially mounted to or placed in a printer, the printer or a host connected to the printer sends information on a time point (for example, date and time) at which the brand-new ink cartridge 5,6 is initially placed in the printer so that the information on the initial placement time point is written in the storage device 53 of the ink cartridge 5,6. The information on the initial placement time point as well as the information on the time length of the effective use, both stored in the storage system 53 of the ink cartridge 5,6, can be used as the effectively-usable period information.

Figure 6:
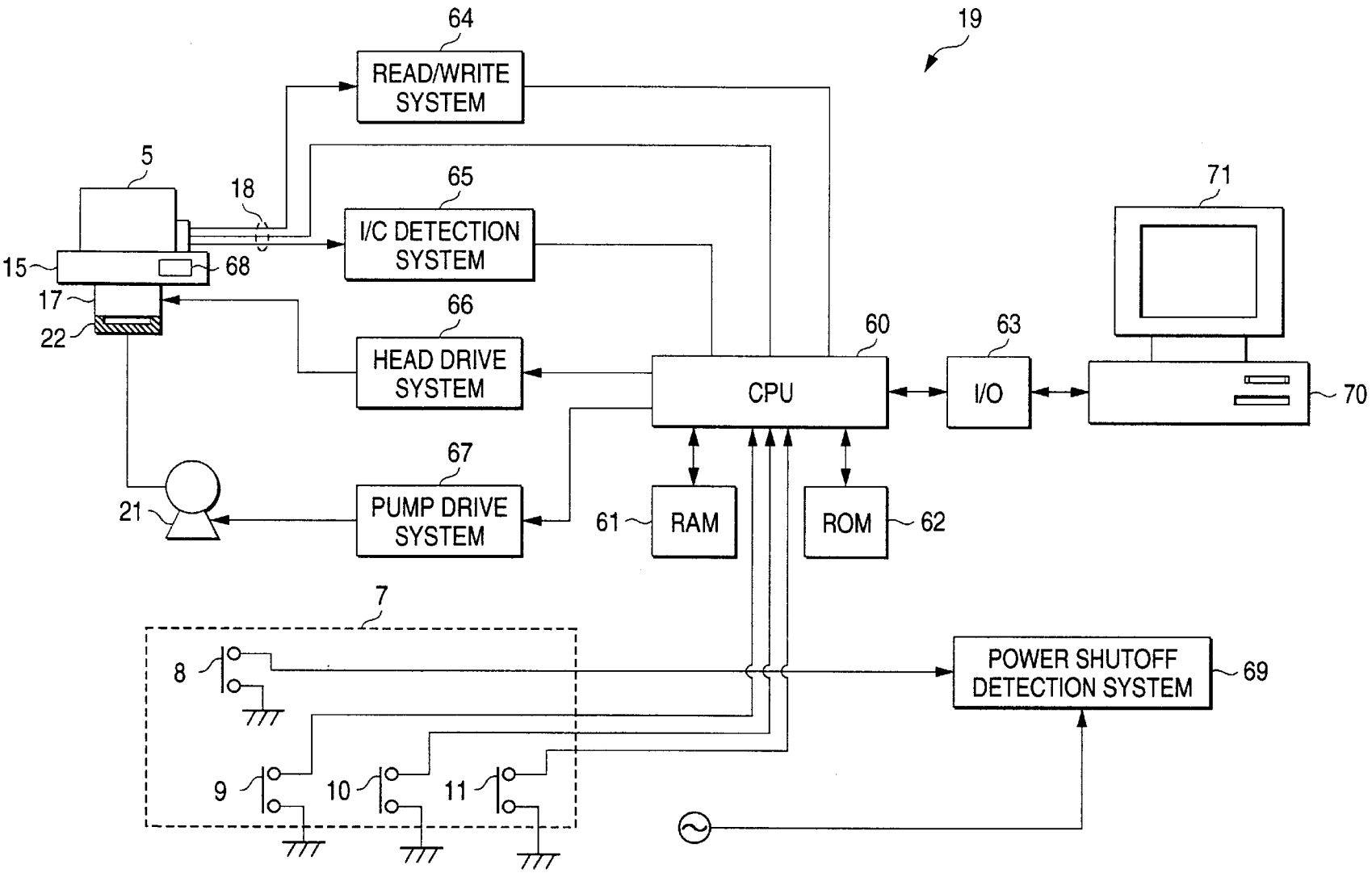
FIG. 6 is a block diagram to show one embodiment of the invention.

FIG. 6 shows an example of the above-mentioned controller 19. A CPU (central processing unit) 60, RAM (random access memory) 61, and ROM (read-only memory) 62 constitute a microcomputer, which is connected to a host 70 by an interface 63. The RAM 61 functions as work memory of the CPU 60, and is provided with an area for temporarily storing data of the ink cartridge 5, 6 which is read by a read/write system 64 from the semiconductor storage system 53 of the ink cartridge. The ROM 62 stores a control program.

An ink cartridge detection system 65 senses whether or not the ink cartridge is placed in the printer based on the conduction state of two contacts that are electrically conducted together by a relatively large electrode 52 on the circuit board 50 of the ink cartridge 5, 6. That is, if the ink cartridge is placed in the printer, a conduction path is formed, so that the detection system 65 senses the ink cartridge placed in the printer, whereas if the ink cartridge is not placed in the printer, a conduction path is not formed, so that the detection system 65 senses the absence of the ink cartridge.

The carriage 15 is provided with an ambient condition detection system (in the embodiment, a temperature detection system 68) to detect the ambient condition (in this embodiment, the temperature of the ink cartridge).

The printer outputs a drive signal to the record head 17 by the drive system 66 based on print data from the host 70 so that the record head 17 ejects ink droplets. If an operation command of ink droplet ejection recovery is given by operating the cleaning command switch 10, etc., the printer actuates the pump unit 21 by the pump drive system 67 to forcibly discharge ink from the record head 17. The amounts of ink consumed by the printing and the cleaning are counted by the microcomputer and stored in the ROM 62.

In FIG. 6, numeral 69 denotes a power shutoff system for supplying power from operating of the power switch 8 on the operation panel 7 to completion of termination processing of the printer, then shutting off the commercial power.

Figure 7:
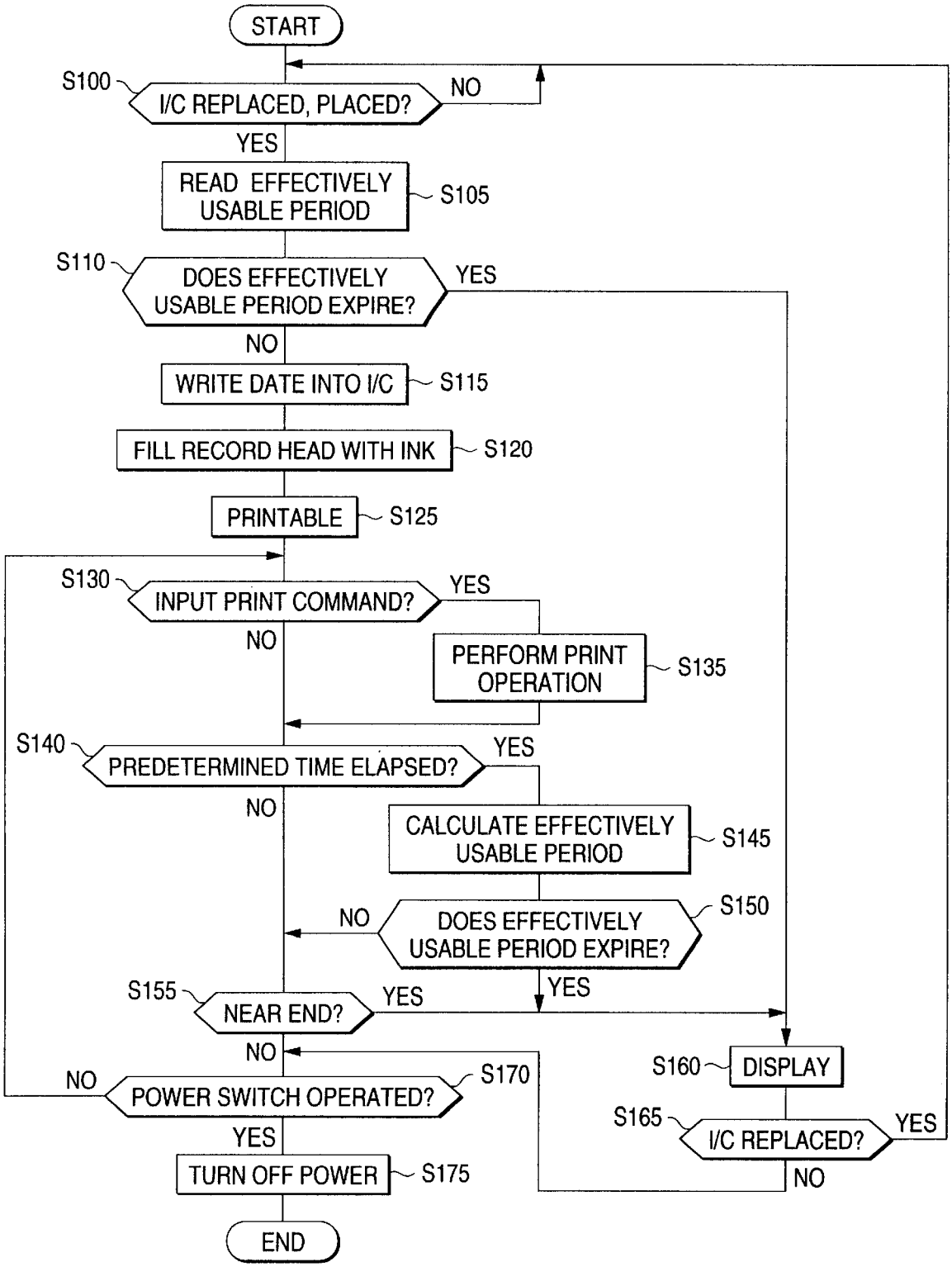
FIG. 7 is a flowchart to show the operation of the ink jet printer.

Next, an operation applicable to the printer will be discussed with reference to a flowchart of FIG. 7.

As known, the printer is connected to the host 70 by a cable and is controlled by printer driver software preliminarily installed in the host 70.

In this state, to replace the ink cartridge, the driver software is started to display an ink cartridge replacement menu, and an ink cartridge replacement command is given or the cartridge replacement command switch 9 is operated.

Then, a replacement command signal is input to the control section of the printer from the host 70 or the cartridge replacement command switch 9, and the microcomputer of the printer performs predetermined processing. That is, the carriage 15 is moved to the ink cartridge replacement position, and when the ink cartridge is replaced at step S100, the effectively usable period information is read by the read/write system 64 from the storage system 53 of the ink cartridge at step S105 and is stored in the RAM 61 or the ROM 62 of the printer. In this embodiment, in a case where a brand-new ink cartridge 5, 6 is placed in, the printer, a maximum effectively usable period, stored at factory shipment, read from the storage system 53 as the effectively usable period information. In this embodiment, in a case where a used ink cartridge 5, 6 is placed in the printer, the remaining time length which was obtained and recorded by updating through subtraction of the elapsed time period is read from the storage system 53 as the effectively usable period information.

To use an ink cartridge storing no information defining the effectively usable period, the information defining effectively usable period may be preliminarily stored in the ROM 62 of the printer, and when such ink cartridge is placed in the printer, the information defining effectively usable period may be read from the ROM 62.

If the effectively usable period of the placed ink cartridge already expires (that is, the effectively usable period is zero) at step S110, a signal is output to the host 70 for causing the host 70 to display the expiration of the effectively usable period or the ink end condition on a display 71 at step S160. If the effectively usable period does not expire (that is, the effectively usable period is not zero), data which are normally stored in the storage system 53 of the ink cartridge when the ink cartridge is placed in the printer, such as information defining the date and time at which the ink cartridge is placed, i.e. the data on the current time point, information defining how many times the ink cartridge is placed, etc. are written into the semiconductor storage system 53 of the ink cartridge at,step S115.

In step S115, data ion the remaining time period obtained by subtracting the elapsed time period from the stored effectively usable period (or the stored remaining time period) may also be written into the storage system 53 of the ink cartridge. These data on the current time point and the remaining time period may be stored in the storage system 53 of the ink cartridge as the updated effectively usable period information to be used for a next ink cartridge checking operation. The carriage 15 is moved, the record head 17 is capped with the capping system 22, and then the pump unit 21 is activated to fill the record head 17 with ink at step S120. In a case where a brand-new ink cartridge 5, 6 is placed in the printer, the storage device 53 of the ink cartridge 5, 6 does not have the information on time point of initial placement, and thus the printer or host can recognize that the ink cartridge placed in the printer is a brand-new ink cartridge. In this case, the program advances to the step S115 where the current time point is written into the storage device 53 of the brand-new ink cartridge as the information on time point of initial placement.

In addition, the current time point that is obtained from the timer system of the printer or the host or that is stored in the storage system 53 of the cartridge can be used as cartridge use information.

When a printable state is thus established in this manner at step S125, and a print command is input from the host 70 at step S130, the microcomputer drives the record head 17 by the head drive system 66 to eject ink droplet from the record head 17, thereby executing the print operation at step S135.

Whenever a constant time (a predetermined time period) has elapsed during such print operation at step S140, the microcomputer detects the environment (the ambient condition) around the ink cartridge. In this embodiment, the microcomputer detects the ambient condition by integrating temperature data from the temperature detection system 68. On the basis of the ambient condition thus detected, the microcomputer calculates the effectively usable period at step S145 to modify the stored effectively usable period if necessary depending on the ambient condition. For example, if the ink cartridge is used at a temperature lower than the average environmental temperature, then less ink solvent evaporates, thus the effectively usable period is modified to be prolonged. On the other hand, if the ink cartridge is used at a higher temperature, the ink solvent evaporates at a high speed and the ink is easily increased in viscosity, thus the effectively usable period is made shorter than the stipulated value. In addition, the ambient condition thus detected can be used as cartridge use information.

Alternatively, the cartridge use information maybe modified depending on the ambient condition. For example, if the ink cartridge is used for one month under a temperature range from T1 to T2, i.e. a lower temperature range, then it is determined in step S145 that the use of the one month under the lower temperature range is equivalent to the use of 0.5 month under a normal temperature range from T2 to T3. Subsequently, in step S150, it is determined as to whether or not the effectively usable period expires by comparing the remaining time period (for example, 5 months) stored in the storage system 53 of the ink cartridge with the determined use period, i.e. 0.5 month. If it is determined in step S150 that the effectively usable period does not expire, the remaining time period (5 months) and time point at which the remaining time period was calculated are updated to be a new remaining time period (4.5 months) and a current time point at which the step S145 is conducted. These new remaining time period and the current time point are stored in the storage system 53 of the ink cartridge as the updated effectively usable period information to be used for a next ink cartridge checking operation.

Similarly, for example, if the ink cartridge is used for one month under a temperature range from T3 to T4, i.e. a higher temperature range, then it is determined in step S145 that the use of the one month under the higher temperature range is equivalent to the use of 2 months under the normal temperature range from T2 to T3. Subsequently, in step S150, it is determined as to whether or not the effectively usable period expires by comparing the remaining time period (for example, 5 months) stored in the storage system 53 of the ink cartridge with the determined use period, i.e. 2 months. If it is determined in step S150 that the effectively usable period does not expire, the remaining time period (5 months) and time point at which the remaining time period was calculated are updated to be a new remaining time period (3 months) and a current time point at which the step S145 is conducted. These new remaining time period and the current time point are stored in the storage system 53 of the ink cartridge as the effectively usable period information to be used for a next ink cartridge checking operation.

When the ink in the cartridge placed in the printer is consumed to reach the near end, namely, the ink amount is reduced to be close to a state in which the ink cartridge becomes empty of ink at step S155, a signal is output to the host 70 for causing the host 70 to display the ink end condition on the display 71 at step S160, requesting the user to replace the ink cartridge with another ink cartridge. When the ink cartridge is replaced with a new one at step S165, the program returns to step S100. If the ink cartridge is not replaced, the program waits the power-off by operating the power switch 8 in this state at step S170.

On the other hand, if the effectively usable period expires at step 8150 before the ink is consumed to the near end, a signal is output to the host 70 for causing the host 70 to indicate on the display 71 that the effectively usable period expires at step S160, recommending the user to replace the ink cartridge. This can prevent the poor print quality caused due to erroneous long-time-use of the cartridge. This can also prevent the life of the record head 17 from being shortened by meaningless cleaning intended for recovering an essential print failure caused by degradation of ink. When the ink cartridge is replaced with a new one, the program returns to step S100; if the ink cartridge is not replaced, the program waits the power-off by the power switch 8 in this state at step S170.

When print terminates and a power off command is given by operating the power switch 8 at step S170, the data concerning the ink cartridge in the RAM 61 is saved in the ROM 62 and upon completion of the termination processing, the power is turned off at step S175. The necessary information such as cartridge use information may be transferred from the RAM 61 and/or ROM 62 to the storage system 53 of the cartridge and saved therein before the power is turned off.

By the way, to still more improve the print quality, a degassed rate of ink in the ink cartridge is increased, and the ink cartridge is wrapped in an airtight bag or container and distributed under strict management, but there is also a limitation on maintaining the airtight property of wrapping and the components of ink also change in quality regardless of the environment and thus have absolute time restrictions.

Thus, it is considered that the life from shipment of the ink cartridge, namely, expiration date after manufacture is displayed on a wrapper (package) for warning the user and is also stored in the storage system of the ink cartridge for management in the printer.

Information defining the expiration date after manufacture, which is stored in the storage system of the ink cartridge may be information indicative of a manufactured date or may be information indicative of an actual expiration date which is the same as the expiration data described on the wrapper and which is calculated based on the information indicative of the manufactured date. In a case where the information indicative of the manufactured date is stored in the storage system of the ink cartridge, information indicative of an effective time period after manufacture may be preliminarily stored in the printer to calculate the expiration date after manufacture based on the information indicative of the manufactured date and the information indicative of the effective time period after manufacture.

Figure 8:
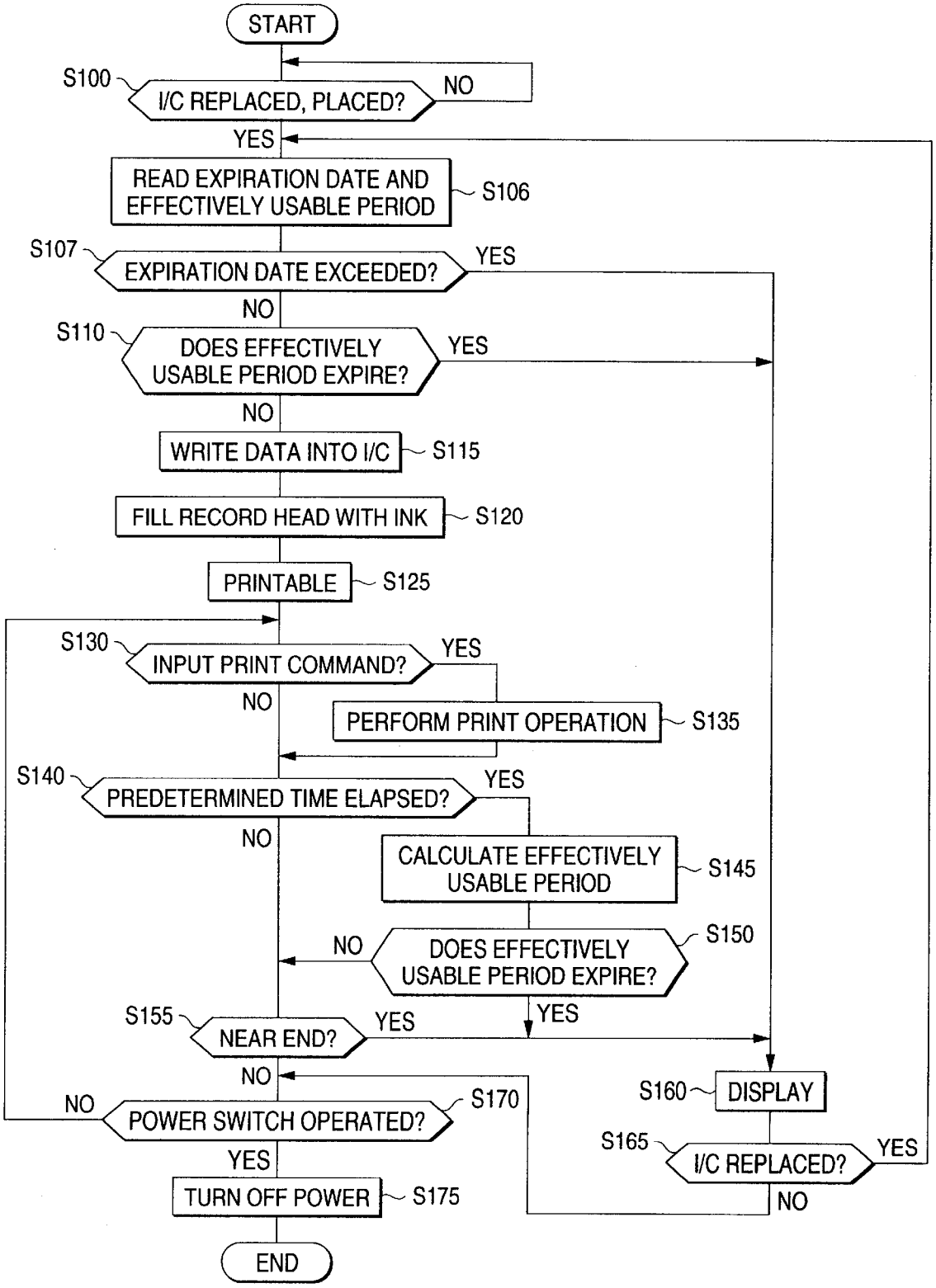
FIG. 8 is a flowchart to show another embodiment of the invention.

FIG. 8 shows an example of a flowchart adapted to manage an ink cartridge in which the data concerning such an expiration date after manufacture is stored.

When the ink cartridge is placed at step S100, the data defining the expiration date after manufacture and effectively usable period are read by the read/write system 64 from the storage system 53 of the ink cartridge 5 at step S106, and are stored in the RAM 61 or the ROM 62 of the printer.

If the expiration date after manufacture of the placed ink cartridge is already exceeded at step S107, a signal is output to the host 70 for causing the host 70 to display the ink end condition or a fact that the expiration date after manufacture is exceeded, on the display 71 at step S160, requesting the user to replace the ink cartridge.

On the other hand, If the expiration date of the placed ink cartridge is not exceeded, a determination is subsequently made as to the effectively usable period at step S110. If the effectively usable period expires, a signal is output to the host 70 for causing the host 70 to display the ink end condition or a fact that effectively usable period expires, on the display 71 at step S160, requesting the user to replace the ink cartridge.

If the expiration date after manufacture is not exceeded and the effectively usable period does not expire, a series of data to be normally stored in the storage system 53 of the ink cartridge when the ink cartridge is placed, such as data defining the date and time at which the ink cartridge is placed, i.e. data on a current time point, etc. are written into the storage system 53 of the ink cartridge at step S115 and the record head 17 is filled with ink at step S120. In step S115, the remaining time length may also be stored in the storage system 53 of the ink cartridge. These current time point and remaining time length may be stored in the storage system 53 of the ink cartridge as the updated effectively usable information to be used for a next ink cartridge checking operation.

Thereafter, the program executes the same steps S130 to S175 as those described with reference to FIG. 7.

The provision of the steps S106 and S107 is advantageous in the following point: There is a case that the expiration date after manufacture is exceeded although the ink remaining amount is sufficient and the effectively usable period still remains. In this case, the program advances from step S107 to the step 160 where a signal is output to the host 70 for causing the host 70 to indicate on the display 71 that the expiration date after manufacture is exceeded, thereby recommending the user to replace the ink cartridge. This can prevent degradation of the print quality caused by essential degradation of ink because a long time has elapsed from manufacturing of the ink cartridge, and can also prevent the life of the record head 17 from being shortened by meaningless cleaning intended for recovering an essential print failure caused by degradation of ink.

In the embodiments described above, the data concerning the effectively usable period for each environment are stored in the storage system of the ink cartridge; however, it is obvious that a similar advantage can be obtained if such data are stored in the storage system of the printer or the host computer connected to the printer. As to the calculation executed by the controller in the printer, the host computer can also be used to execute the calculation in place of or in combination with the controller in the printer. Further, driver software by which the host computer operates the printer can be supplied in the form of a storage media or through a net work such as an internet, and in this case, a program for practicing the present invention can be incorporated into the driver software.

In the description, the printer of the type wherein the ink cartridge is mounted on the carriage is taken as an example; however, a similar advantage can be obtained if the invention is applied to an ink jet printer of the type wherein an ink cartridge is installed in a box or case, and ink is supplied to a record head via an ink supply tube.

As described above, the ink jet printer has the ink jet record head, the ink cartridge for supplying ink to the ink jet record head, the ink cartridge having the writable or rewritable storage system storing the effectively-usable information, and the control system for controlling the ink jet record head in response to print data. The control system calculates the effectively usable period based on the elapsed time since the ink cartridge was placed in the printer and the effectively usable period, and updates the effectively usable period stored in the storage system. Thus, the ink cartridge does not require active elements including a microcomputer or a power supply, and the effectively usable period of the ink cartridge can be managed in a simple structure.

Figure 9:
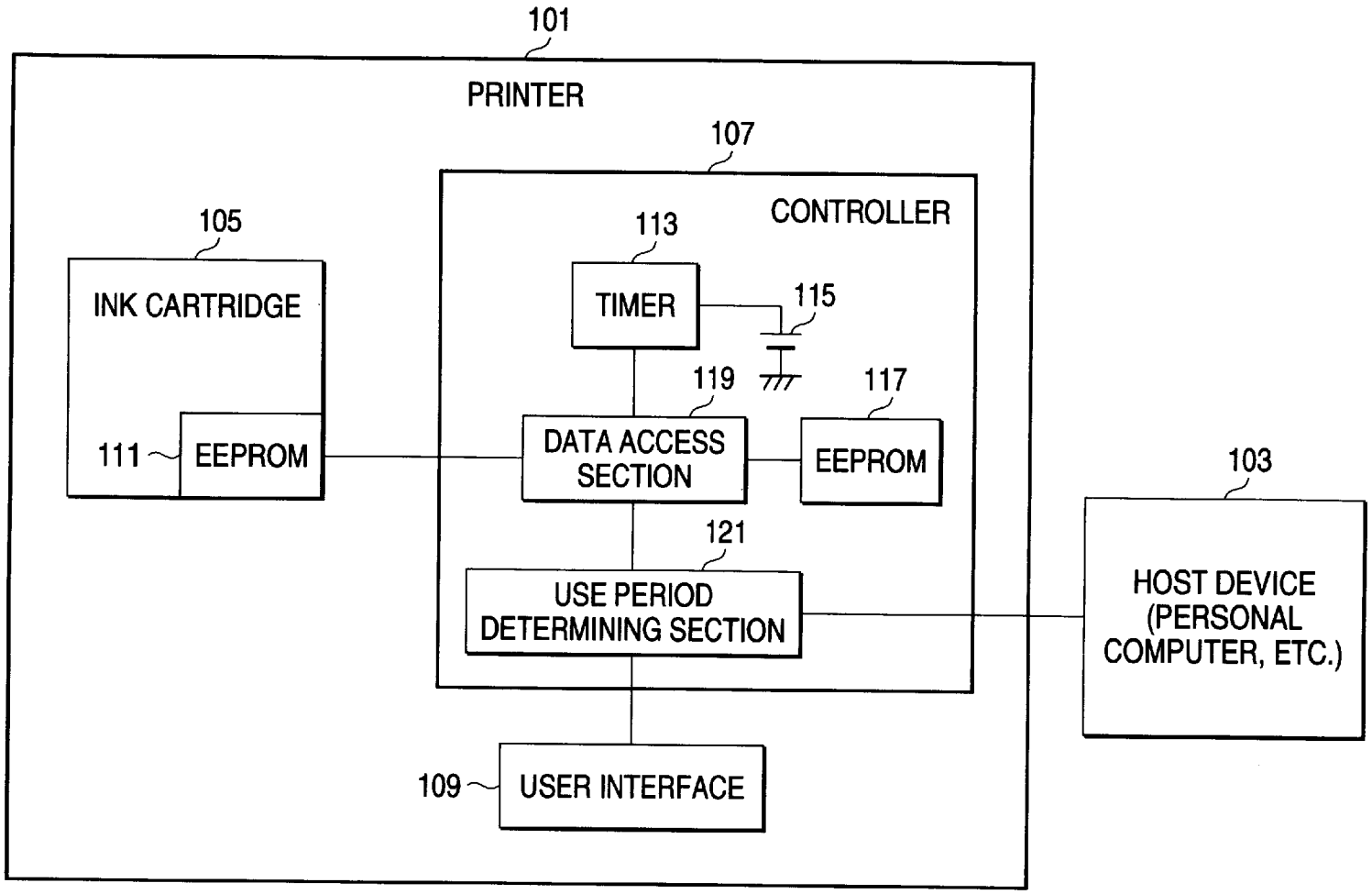
FIG. 9 is a block diagram showing an entire configuration of a print system according to another embodiment of the present invention.

FIG. 9 shows an entire configuration of a print system according to an embodiment of the present invention. As shown in FIG. 9, an ink jet printer 101 is connected to a host device 103 such as a personal computer. The printer 101 has an ink cartridge 105, a controller 107 for controlling the printer 101 and an user interface 109 such as a liquid crystal display, a LED lump, a buzzer, a speaker, etc. The cartridge 105 is of an on-head type in which the cartridge 105 is placed over a head provided on a carriage. The cartridge may be of an off-head type in which the cartridge is placed on a fixed position distanced from a carriage.

The ink cartridge 105 is provided with a writable or rewritable nonvolatile storage medium, such as EEPROM 111, having a plurality of memory areas to which various cartridge use information can be written and stored. The cartridge use information includes information on a time period from an initial time point at which the brand-new cartridge 105 is initially mounted or placed on a printer to a current time point at which the ink cartridge is currently mounted or placed on the printer or a printer.

The controller 107 has a timer 113 for counting time, a battery 115 for continuously activating the timer 113 regardless of whether power for the printer 101 is turned on or off, a writable or rewritable nonvolatile storage medium, such as EEPROM 117, for storing a time period from a time period lasting from a time point at which the ink cartridge 105 is placed on the printer 101, a data access section 119 for access to the EEPROM to read and write data from and to the EEPROM 117, and a use period determining section 121 for determining whether or not the ink cartridge 105 can be used. The use period determining section 121 determines, for example, whether or not the ink cartridge 105 can be used based on effectively usable period information and cartridge use information.

Next, with reference to FIG. 9, the operation of the print system will be described.

When the ink cartridge 105 is newly placed on the printer 101, the printer 101 obtains a current time point (date and time when the ink cartridge 105 is placed on the printer 101) from the timer 113, and records the current time point in the EEPROM 117 provided in the printer 101. When the ink cartridge 105 is to be replaced, the printer 101 obtains a current time point (date and time when the ink cartridge 105 is detached) from the timer 113 just before the ink cartridge 105 is detached from the printer 101, and calculates a time difference (a time period) between the detached time point and the placed time point stored in the EEPROM 117. That is, the time length for which the ink cartridge 105 has been placed in the printer 101 is calculated. Then, the calculated time difference is added to the timer period stored in EEPROM 111 of the ink cartridge 105 as cartridge use information. The time period obtained by this addition is written on the EEPROM 111 of the ink cartridge 105. This processing of calculating the ink cartridge placement time period and updating the cartridge use information that indicates the time period from the initial placement and that is stored in the EEPROM 111 can be performed periodically and/or at the time of turning off the power for the printer 101, in addition to or in place of when the ink cartridge 105 is detached.

With this processing, even if the ink cartridge 105 is used with a plurality of printers, and even if setting of absolute time and date in the printers are different from one another, EEPROM 111 of the ink cartridge 105 holds (stores) summed-up value indicative of a time period for which the ink cartridge 105 has been placed in the printers. Accordingly, the information on the time period from the initial placement of the ink cartridge to the current time point can be stored as the cartridge use information.

The information on the time period from the initial placement is read from the EEPROM 111 of the ink cartridge 105 by the controller 107 as required, and the use period determining section 121 determines whether or not the effectively usable period expires. If the effectively usable period expires, then the use period determining section 121 outputs a signal to the user interface 109 of the printer 101 so that the expiration is informed to the user by, for example, a buzzer alarm, flashing of the LED lump, a message on the display, etc. The signal may be outputted to the host device 103 so that the expiration is informed to the user by the user interface of the host device 103.

Figure 10A:
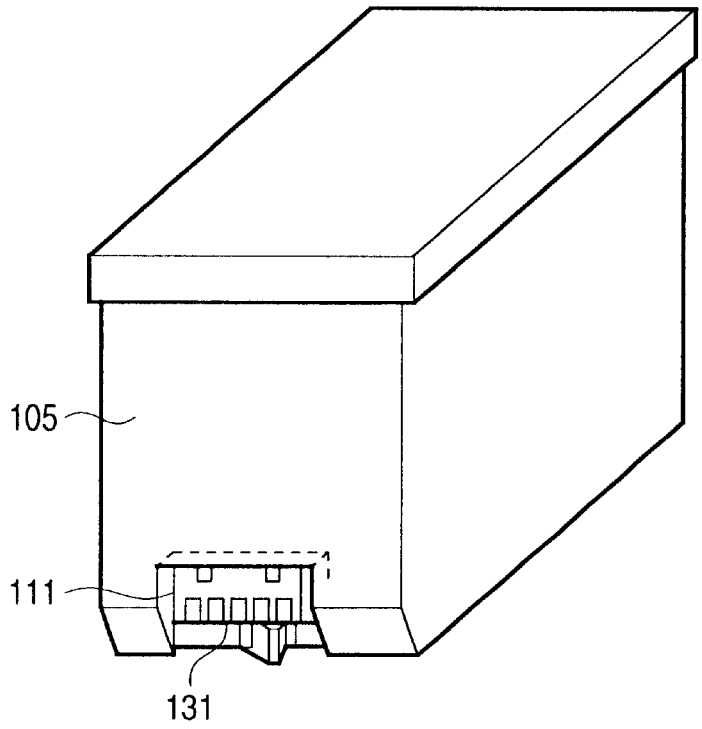
FIG. 10A is a perspective view showing an external configuration of an ink cartridge.
Figure 10B:
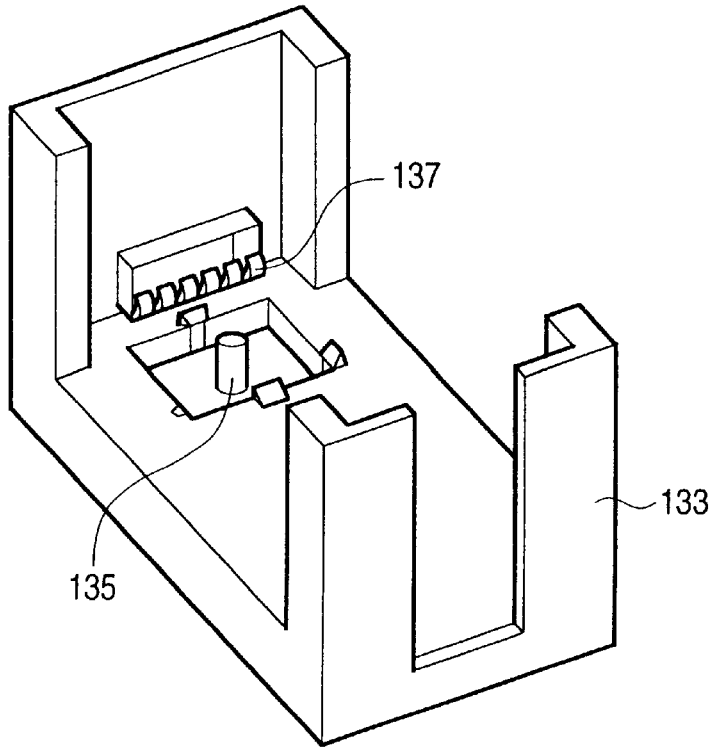
FIG. 10B is a perspective view showing an external configuration of a cartridge holder.

FIG. 10A is a perspective view showing an external configuration of the ink cartridge 105, and FIG. 10B is a perspective view showing an external configuration of a cartridge holder 133, provided in the printer 101, for holding the ink cartridge 105.

An ink pack accommodating ink therein is installed with the ink cartridge 105, and the EEPROM 111 is mounted onto an outer surface of the ink cartridge 105 so that access terminals 131 of the EEPROM 111 are exposed to the exterior. The cartridge holder 133 has a needle 135 and contact terminals 137 on its inside surface. When the ink cartridge 105 is mounted to the holder 133, the needle 135 is pieced into the ink pack of the cartridge 105 to suck the ink, and the contact terminals 137 are contacted with the access terminals 131 of the EEPROM 111 to send and receive electric signals between the EEPROM 111 and the printer 101.

Next, a processing program for the printer 101 will be described in detail with reference to a flowchart.

Figure 11:
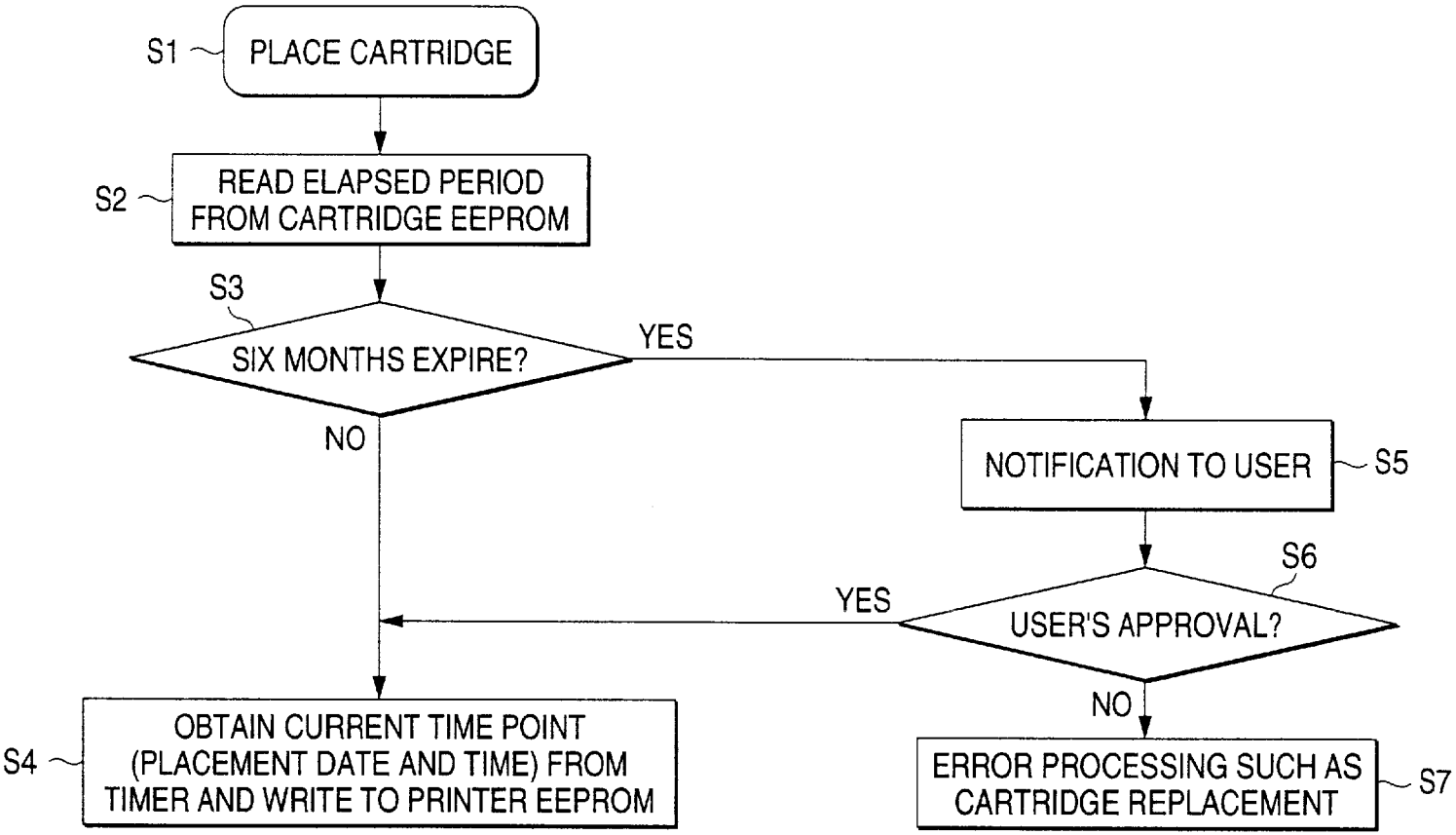
FIG. 11 is a flowchart showing a processing in a printer when an ink cartridge is placed in the printer.

FIG. 11 shows a processing program to be executed when an ink cartridge is placed.

When the ink cartridge 105 is placed in the printer 101 (Step S1), the data access section 119 of the controller 107 reads the cartridge use information, namely information on the time period from the initial placement, from the EEPROM 111 of the ink cartridge 105 (Step S2). The data access section 119 also reads the effectively usable period information from the EEPROM 111. The effectively usable period information indicates; for example, a period of six months.

Then, the use period determining section 121 determines whether or not the period from the initial placement is less than the period of six months at step S3. If it is determined that it is less than the period of six months, then the data access section 119 reads a current time point (time and date when the ink cartridge 105 is placed) from the timer 113 so that the current time point is written in the EEPROM 117 of the printer 101.

On the other hand, if it is determined that it is not less than the period of six months (step S3, Yes), then the fact that the effectively usable period expires is informed to the user by the LED lamp, the display, buzzer, etc., of the user interface 109 (for example, the expiration of the effectively usable period and the time period from the initial placement are informed to the user) at step S5. This fact is also informed to the host device 103. Then, the printer 101 or the host 103 asks the user as to whether or not the use of the expired ink cartridge is approved (step S5), and based on a signal from the user interface 109 or the host 103, it is determined whether or not the user approves the use of the expired ink cartridge (step S6). If the user approves (Yes, step S6), the currently placed ink cartridge 105 is used without replacement, and a current time point (date and time when the ink cartridge 105 is placed) is read from the timer 113 of the printer, and written into the EEPROM 117 of the printer 101 (step S4) to complete the program. In step S6, if the user does not approve the use of the expired ink cartridge (No, step S6), the program enters an error processing such as the replacement of the ink cartridge 105.

Figure 12:
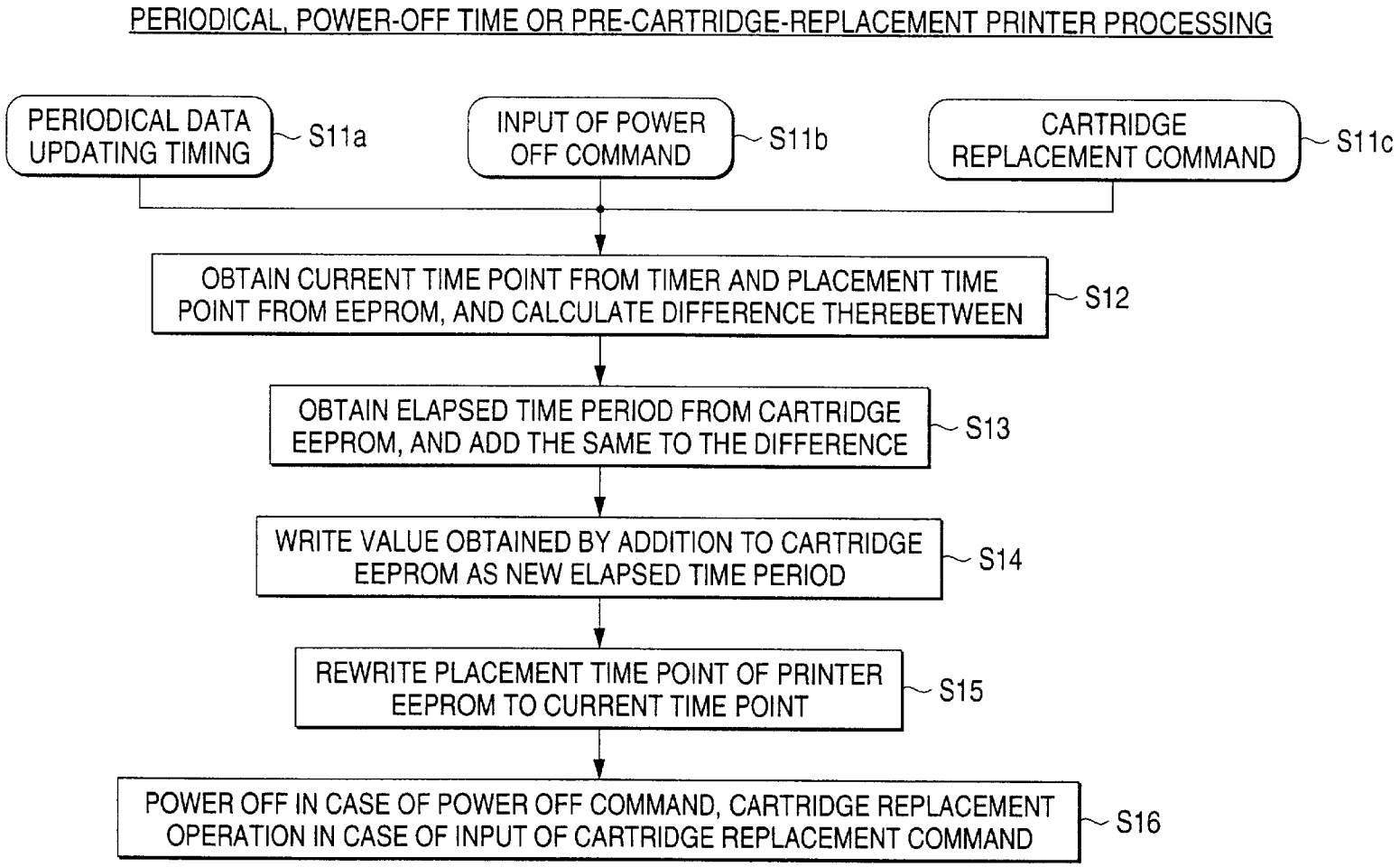
FIG. 12 is a flowchart showing a processing in the printer to update an elapsed time period of the ink cartridge periodically, when power for the printer is turned off, or when the ink cartridge is replaced.

FIG. 12 is a flowchart for a program to be executed when the cartridge use information, namely the information on the use period from the initial placement, is updated by the printer periodically, at the time of turning-off of the power and/or at the time of the replacement of the ink cartridge.

As shown in FIG. 12, when a periodic data updating timing is reached (S11*a*), when a power turning-off command for the printer 101 is inputted (S11*b*), or when an ink cartridge replacement command is inputted (S11*c*), the data access section 119 obtains a current time point (current date and time) from the timer 113, and the previous time point (date and time when the ink cartridge 105 was placed) from the EEPROM 117 of the printer, and calculates a time difference therebetween (S12).

Then, the data access section 119 obtains the cartridge use information, namely, the information on the time period from the initial placement, from the EEPROM 111 of the ink cartridge 105, and adds the calculated time difference to the time period from the initial placement (S13). The time period thus obtained by this addition is over-written on the EEPROM 111 of the ink cartridge 105 as a new information on the time period from the initial placement (S14).

Further, the time point (date and time when the ink cartridge 105 was placed) stored in the EEPROM 117 of the printer 101 is updated by a current time point (S15), and then the power for the printer 101 is turned off in accordance with the inputted power-turning-off command, or the program-advances to a cartridge replacement processing in accordance with the inputted ink cartridge replacement command.

Figure 13:
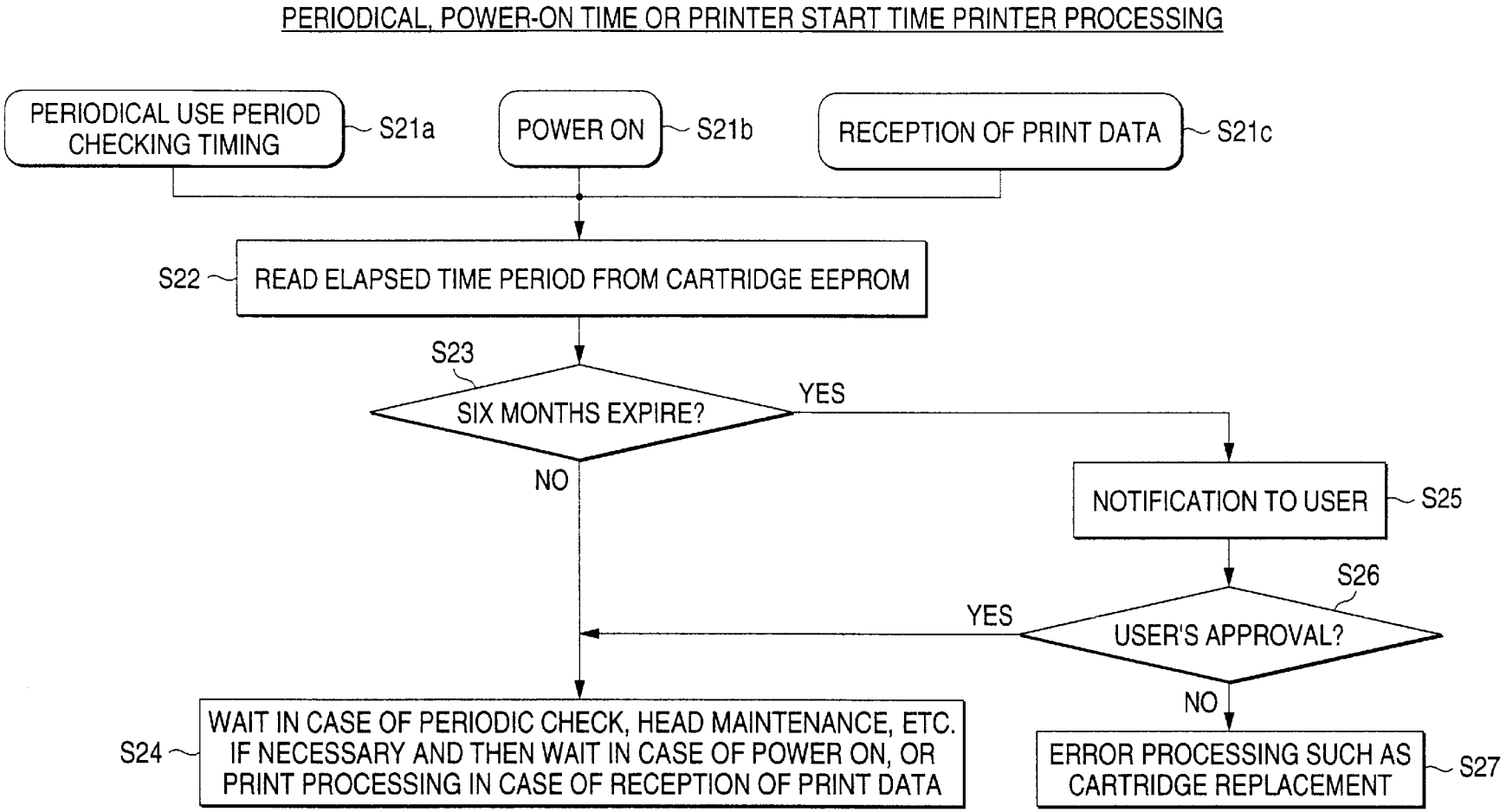
FIG. 13 is a flowchart showing a processing in the printer to check an effectively usable period of the ink cartridge periodically, when power for the printer is turned on or when print is started.

FIG. 13 shows a flowchart for a program to be executed to check the effectively usable period of the ink cartridge periodically, when the power is turned on, and/or when print is to be started.

As shown in FIG. 13, when a periodic usable period checking timing is reached (S21*a*), when the power for the printer 101 is turned on (S21*b*), or when print data are sent to the printer 101 (S21*c*), the data access section 119 obtains the effectively usable period information and the cartridge use information, namely, information on the time period from the initial placement, from EEPROM 111 of the ink cartridge 105 (S22), and use period determining section 121 determines whether or not the effectively usable period, namely the period of six months, expires (S23).

If the period of six months does not expire (No, S23), the program advances to step S24 where a wait condition is established in case of the periodic check, a maintenance for the print head, etc. are conducted if necessary and then the wait condition is established in case of the power on, the print processing is conducted in case of the reception of the print data.

On the other hand, if the period of six month expires (S23, Yes), then the fact that the effectively usable period expires is informed to the user by the user interface 109 and/or the host device 103 (for example, the expiration of the affectively usable period and the time period from the initial placement are informed to the user, and the printer 101 or the host 103 asks the user as to whether or not the use of the expired ink cartridge is approved (S25). Based on a signal from the user interface 109 or the host 103, it is determined whether or not the user approves the use of the expired ink cartridge (S26). If the user does not approve the use of the expired ink cartridge (No, S26), the program enters an error processing such as the replacement of the ink cartridge 105 (S27).

If the user approves (Yes, S26), the currently placed ink cartridge 105 is used without replacement, and similarly to the case where the period of six month does not expires, the program advances to step S24 where a wait condition is established in case of the periodic check, a maintenance for the print head, etc. are conducted if necessary and then the wait condition is established in case of the power on, the print processing is conducted in case of the reception of the print data.

In addition, in case where the above-described calculation processing can not be executed due to some reasons, such as out-of-function of the timer 113, the controller 107 rewrites the information on the time period from the initial placement in the EEPROM 111 of the ink cartridge 105 to be, for example, a maximum value. With this, the controller 107 of the printer will recognize the ink cartridge 105 such that the information on the time period from the initial placement is unavailable (or the effectively usable period has already expired).

Various modifications can be made without departing from the sprit and scope of the present invention. For example, the information on the time period from the initial placement, which is stored in the memory of the cartridge, may not be updated using information on the time difference or time period for which the ink cartridge is placed in the printer. That is, such a data management is applicable, that time differences or time periods for which the ink cartridge is placed in respective printers are stored in the memory of the ink cartridge on printer-by-printer basis, and all of the time periods are summed up to calculate the time period from the initial placement when the effectively usable period is checked.

Figure 14:
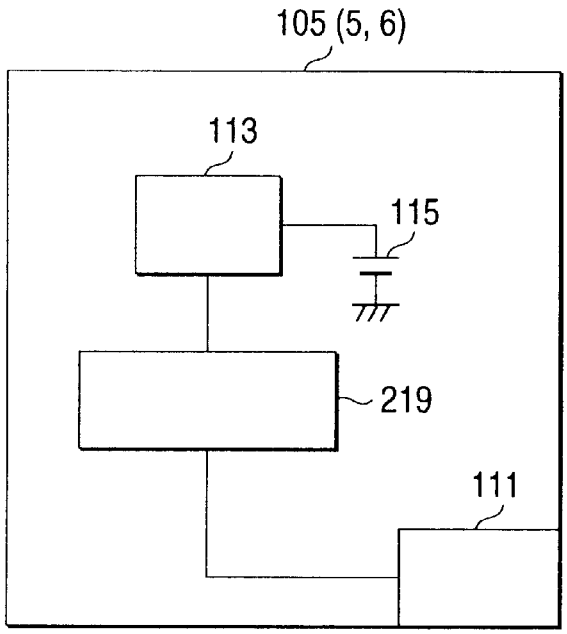
FIG. 14 is a schematic view showing another example of an ink cartridge.

Further, the printer may not have the timer, and a timer installed in the host device may be used in place of the timer in the printer. Moreover, as shown in FIG. 14, the ink cartridge 105 (5, 6) may have a timer 113 which can be used similarly to the timer 113 provided in the printer. Reference numeral 115 designates a battery serving as a power source for the timer 113 provided in the ink cartridge 105 (5, 6), and reference numeral 219 designates a data access section for reading information from the timer 113 provided in the cartridge 105 (5, 6) and writing information into the EEPROM 111 based on the information provided from the timer 113 of the cartridge 105 (5, 6).

Figure 15:
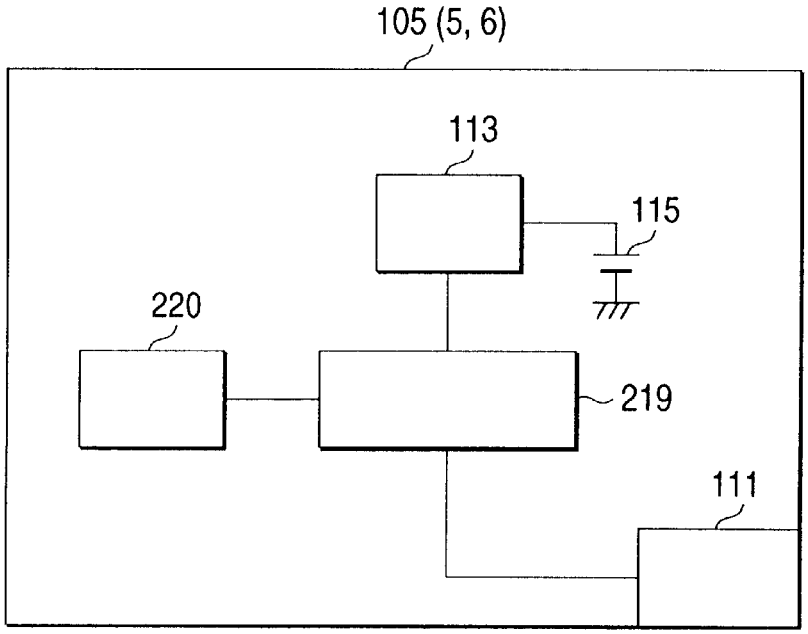
FIG. 15 is a schematic view showing yet another example of an ink cartridge.

In case of providing the timer 113 to the ink cartridge 105 (5, 6), it is preferable to further provide a detector 220, i.e. a photoelectric detector, a pressure change sensitive detector or the like, to the ink cartridge 105 (5, 6) as shown in FIG. 15. As described above, the brand-new ink cartridge 105 (5, 6) placed in markets is wrapped by a package such a light-shielding and air-tight bag or container in order to keep ink quality. When the brand-new ink cartridge 105 (5, 6) is to be initially placed in a printer, the package is broken or opened and the ink cartridge 105 (5, 6) is removed from the package. The detector 220 detects a change in ambient condition when the package is broken or opened, and provides a detection signal to the data access section 219. Upon reception of the detection signal, the data access section 219 reads a current time point (date and time) from the timer 113 and stores the current time point in the EEPROM 111, or instructs the timer 113 to initiate a time counting. Accordingly, in the modification shown in FIG. 15, information on a time point at which the package for the brand-new cartridge 105 (5, 6) is broken or opened, or information on a time period lasting from a time point at which the package for the brand-new cartridge 105 (5, 6) is broken or opened is obtained as the cartridge use information. The obtained information can be used in place of the above-noted. information on the time point at which the brand new ink cartridge is initially placed in the printer, or the information on the time period from the initial placement.

Note that the term printer or ink jet printer used in the specification and claims is intended to encompass not only an ink jet printer but also any types of machines, such as a copy machine and a facsimile machine, which can execute printing sing an ink jet type head.

Further, the term storage system or storage medium used in the specification and claims is intended to encompass not only a semi-conductor storage system but also any types of storage systems such as a magnetic storage system and an optical storage system, which can store data therein.

What is claimed is:

1. An ink jet printer comprising an ink jet record head, and at least one ink cartridge for supplying ink to said ink jet record head, the ink cartridge having a writable or rewritable storage system storing information defining an effectively usable period of the ink cartridge, wherein the information defining the effectively usable period stored in the storage system is updated by information defining a new effectively usable period, which is obtained through calculation based on an elapsed time period for which the ink cartridge is placed in the printer and the effectively usable period defined by the information stored in the storage system.

2. The ink jet printer as claimed in claim 1, wherein the information defining the effectively usable period is updated at a constant time interval.

3. The ink jet printer as claimed in claim 1, wherein the effectively usable period is modified based on environmental temperature.

4. The ink jet printer as claimed in claim 3, wherein the effectively usable period is prolonged or shortened.

5. The printer as claimed in claim 1, wherein the information defining the effectively usable period indicates a time point.

6. The printer as claimed in claim 1, wherein the information defining the effectively usable period indicates a time period.

7. The printer as claimed in claim 1, wherein the information defining the new effectively usable period is stored in the storage system.

8. An ink jet printer comprising an ink jet record head, and at least one ink cartridge for supplying ink to the ink jet record head, wherein an effectively usable period of the ink cartridge or an expiration time point of the effectively usable period is calculated based on environmental temperature.

9. The ink jet printer as claimed in claim 8, wherein the ink cartridge has a storage system, and information defining the effectively usable period is stored in the storage system.

10. An ink jet printer comprising an ink jet record head, and at least one ink cartridge for supplying ink to the ink jet record head, the ink cartridge having a storage system storing data defining a fixed expiration date since the ink cartridge was manufactured and data defining an effectively usable period having a variable expiration date, wherein the effectively usable period corresponds to a quality of the ink; and wherein a signal indicative of a status is generated when either the expiration date is exceeded or the effectively usable period expires.

11. The printer as claimed in claim 10, wherein the effectively usable period lasts from a time point at which the ink cartridge was initially placed in the printer.

12. The printer as claimed in claim 10, wherein the effectively usable period lasts from a time point at which the ink cartridge was initially placed in another, different printer.

13. The printer as claimed in claim 10, wherein the effectively usable period lasts from a time point at which a package for the ink cartridge is broken or opened.

14. The ink jet printer as claimed in claim 10, wherein the effectively usable period is modified based on environmental temperature.

15. The ink jet printer as claimed in claim 14, wherein the effectively usable period is prolonged or shortened.

16. An ink cartridge having a storage system, wherein the storage system is provided with at least one memory area capable of storing information defining an expiration of a usable period lasting from a time point at which the ink cartridge was manufactured, and information defining an effectively usable period that lasts from a time point at which use of the ink cartridge was started; and wherein the effectively usable period corresponds to a quality of the ink.

17. The ink cartridge as claimed in claim 16, wherein the time point at which the use of the ink cartridge was started includes a time point at which the ink cartridge was initially placed in the printer or a printer.

18. An ink cartridge having a storage system, wherein the storage system is provided with at least one memory area capable of storing information defining an expiration of a usable period lasting from a time point at which the ink cartridge was manufactured, and information defining an effectively usable period that lasts from a time point at which use of the ink cartridge was started; and wherein the time point at which the use of the ink cartridge was started includes a time point at which a package for the ink cartridge was broken or opened.

19. The ink cartridge as claimed in claim 16, wherein the information defining the effectively usable period is stored so that it can be updated.

20. A print system comprising a printer adapted to detachably mount at least one ink cartridge having a first storage system thereon and to execute print through supply of ink from the ink cartridge, and a host device communicatable with the printer, the printer system further comprising;

a time period data recording system, provided in at least one of the printer and the host device, for calculating a time period for which the ink cartridge is placed in the printer, and recording data relating to the time period in the first storage system of the ink cartridge; and a time period expiration determining system, provided in at least one of the printer and the host device, for recognizing an elapsed time period from a time point at which use of the ink cartridge was started, based on data recorded in the first storage system of the ink cartridge, and determining whether or not an effectively usable period expires based on the elapsed time period.

21. The print system as claimed in claim 20, wherein the time point at which the use of the ink cartridge was started includes a time point at which the ink cartridge in a brand-new state was initially placed in the printer or a printer.

22. The print system as claimed in claim 20, wherein the time point at which the use of the ink cartridge was started includes a time point at which a package for the ink cartridge in a brand-new state was broken or opened.

23. The print system as claimed in claim 20, wherein:

the time period data recording system adds the time period for which the ink cartridge is placed in the printer to the previous elapsed time period stored in the first storage system of the ink cartridge to obtain a new elapsed time period, and records the new elapsed time period in the first storage system of the cartridge; and the time period expiration determining system reads the new elapsed time period from the first storage system of the cartridge, and determines whether or not the effectively usable time period expires based on the new elapsed time period.

24. The print system as claimed in claim 23, wherein:

the printer has a timer activated continuously regardless of whether power for the printer is turned on or off, a second storage system, and a controller for controlling operation of the printer;

the controller serves as the time period data recording system and the time period expiration determining system to execute;

1). obtaining, when the ink cartridge is newly placed in the printer, a placement. date and time from the timer, and recording the placement date and time into the second storage system;

2) calculating, periodically, or at the time of turning off of the power or immediately before the ink cartridge is replaced, a time difference between a current date and time obtained from the timer and the placement date and time recorded in the second storage system;

3) adding the time difference to the elapsed time period already recorded in the first storage system; and 4) over-writing the elapsed time period obtained by the addition on the first storage system.

25. The print system as claimed in claim 20, further comprising;

a notifying system for notifying a user through the printer or the host device of a fact that the effectively usable time period expires if the time period expiration determining system determines that the effectively usable time period expires.

26. The print system as claimed in claim 20, wherein after a determination that the effectively usable period has expired, the printer or host device queries a user as to whether a continued use of the ink cartridge is approved; and wherein when the user indicates an approval, continued use of the ink cartridge is permitted, otherwise continued use of the ink cartridge is prohibited.

27. An ink jet printer comprising:

at least one replaceable ink cartridge having a first storage system;

a time period data recording system for calculating a time period for which the ink cartridge is placed in the printer, and recording data relating to the time period in the first storage system of the ink cartridge; and a time period expiration determining system for recognizing an elapsed time period from a time point at which use of the ink cartridge was started, based on data recorded in the first storage system of the ink cartridge, and determining whether or not an effectively usable period expires based on the elapsed time period.

28. The printer as claimed in claim 27, wherein the time point at which the use of the ink cartridge was started includes a time point at which the ink cartridge in a brand-new state was initially placed in the printer or a printer.

29. An ink jet printer comprising:

at least one replaceable ink cartridge having a first storage system;

a time period data recording system for calculating a time period for which the ink cartridge is placed in the printer, and recording data relating to the time period in the first storage system of the ink cartridge; and a time period expiration determining system for recognizing an elapsed time period from a time point at which use of the ink cartridge was started, based on data recorded in the first storage system of the ink cartridge, and determining whether or not an effectively usable period expires based on the elapsed time period;

wherein the time point at which the use of the ink cartridge was started includes a time point at which a package for the ink cartridge in a brand-new state was broken or opened.

30. The printer as claimed in claim 27, wherein:

the time period data recording system adds the time period for which the ink cartridge is placed in the printer to the previous elapsed time period stored in the first storage system of the ink cartridge to obtain a new elapsed time period, and records the new elapsed time period in the first storage system of the cartridge; and the time period expiration determining system reads the new elapsed time period from the first storage system of the cartridge, and determines whether or not the effectively usable time period expires based on the new elapsed time period.

31. The printer as claimed in claim 30, further comprising:

a timer activated continuously regardless of whether power for the printer is turned on or off; and a second storage system, wherein time period data recording system executes:

1) obtaining, when the ink cartridge is newly placed in the printer, a placement date and time from the timer, and recording the placement date and time into the second storage system;

2) calculating, periodically, or at the time of turning off of the power or immediately before the ink cartridge is replaced, a time difference between a current date and time obtained from the timer and the placement date and time recorded in the second storage system;

3) adding the time difference to the elapsed time period already recorded in the first storage system; and 4) over-writing the elapsed time period obtained by the addition on the first storage system.

32. The printer as claimed in claim 27, further comprising:

a notifying system for notifying a user through the printer or a host device connected to the printer of a fact that the effectively usable time period expires if the time period expiration determining system determines that the effectively usable time period expires.

33. The printer as claimed in claim 32, wherein after the notifying system has notified the user, the printer or host device queries the user as to whether a continued use of the ink cartridge is approved; and wherein when the user indicates an approval, continued use of the ink cartridge is permitted, otherwise continued use of the ink cartridge is prohibited.

34. An ink cartridge adapted to detachably mounted to an ink jet printer, wherein the ink cartridge has a storage system to which the printer is accessible; and wherein the storage system has a memory area for storing data concerning a time period for which the ink cartridge was placed in the printer;

whereby the printer can recognize an elapsed time period from a time point at which use of the ink cartridge was started, based on data recorded in the storage system.

35. The ink cartridge as claimed in claim 34, wherein the time point at which the use of the ink cartridge was started includes a time point at which the ink cartridge in a brand-new state was initially placed in the printer or a printer.

36. The ink cartridge as claimed in claim 34, wherein the time point at which the use of the ink cartridge was started includes a time point at which a package for the ink cartridge in a brand-new state was broken or opened.

37. A method of managing an effectively usable period of an ink cartridge that is replaceably mounted to a printer and that has a storage system, the method comprising:

a step of calculating a time period for which the ink cartridge is placed in the printer, and recording data relating to the time period in the first storage system of the ink cartridge, the step being executed in at least one of the printer and a host device connected to the printer; and a step of recognizing an elapsed time period from a time point at which use of the ink cartridge was started, based on data recorded in the first storage system of the ink cartridge, and determining whether or not an effectively usable period expires based on the elapsed time period, the step being executed in at least one of the printer and the host device connected to the printer.

38. The method as claimed in claim 37, wherein the time point at which the use of the ink cartridge was started includes a time point at which the ink cartridge in a brand-new state was initially placed in the printer or a printer.

39. A method of managing an effectively usable period of an ink cartridge that is replaceably mounted to a printer and that has a storage system, the method comprising:

a step of calculating a time period for which the ink cartridge is placed in the printer, and recording data relating to the time period in the first storage system of the ink cartridge, the step being executed in at least one of the printer and a host device connected to the printer; and a step of recognizing an elapsed time period from a time point at which use of the ink cartridge was started, based on data recorded in the first storage system of the ink cartridge, and determining whether or not an effectively usable period expires based on the elapsed time period, the step being executed in at least one of the printer and the host device connected to the printer;

wherein the time point at which the use of the ink cartridge was started includes a time point at which a package for the ink cartridge in a brand-new state was broken or opened.

40. A method of checking an ink cartridge, comprising the steps of:

reading effectively usable period information from a first storage system of an ink cartridge placed in a printer or a second storage system of the printer or a host connected to the printer, and at least one of cartridge use information and information defining a current time point respectively from the first or second storage system and a timer system;

obtaining information defining an effectively usable period of the ink cartridge based on the effectively usable period information and at least one of the cartridge use information and the information defining the current time point;

obtaining information defining an elapsed use period based on at least one of the cartridge use information and the information defining the current time point; and comparing the information defining the effectively usable period with the information defining the elapsed use period, wherein the effectively usable period includes a variable expiration date, which varies depending on use of the ink cartridge.

41. The method as claimed in claim 40, wherein the effectively usable period information includes information indicative of a time period predetermined and recommended by a manufacturer.

42. The method as claimed in claim 41, wherein the effectively usable period information further includes information indicative of a time point at which the ink cartridge in a brand-new state was initially placed in the printer or a printer.

43. The method as claimed in claim 42, wherein the effectively usable period information further includes information indicative of a time point at which a package for the ink cartridge was broken or opened.

44. The method as claimed in claim 40, wherein the effectively usable period information includes information indicative of a time period in relation to each of ambient conditions where the ink cartridge is placed.

45. The method as claimed in claim 40, wherein the cartridge use information includes information indicative of a time point obtained from the timer system or a timer system.

46. The method as claimed in claim 40, wherein the cartridge use information includes information indicative of a time period for which the ink cartridge was used from a time point at which the ink cartridge in a brand-new state was initially placed in the printer or a printer or at which a package for the ink cartridge was broken or opened.

47. The method as claimed in claim 44, wherein the cartridge use information includes information indicative of a condition where the ink cartridge was placed.

48. The method as claimed in claim 47, wherein the step of obtaining information defining elapsed use period includes obtaining an expiration time point by elongating or shortening the effectively usable period based on the effectively usable period information and the cartridge use information.

49. The method as claimed in claim 40, wherein the timer system is provided in one of the ink cartridge, the printer and the host.

50. A method of updating information in a storage system of an ink cartridge placed in the printer, comprising: the steps of:

obtaining a first time point from the first storage system of the ink cartridge or a second storage system of the printer or a host connected to the printer;

obtaining a second time point from a timer system;

calculating a time difference between the first and second time points;

updating an elapsed time period or remaining time period stored in the first storage system based on the calculated time difference; and storing the updated elapsed time period or remaining time period in the first storage system.

51. A print system comprising an ink jet record head, and at least one ink cartridge for supplying ink to the ink jet record head, the ink cartridge having a storage system storing data defining a fixed expiration date since the ink cartridge was manufactured and data defining an effectively usable period having a variable expiration date, wherein the effectively usable period corresponds to a quality of the ink; and wherein a signal indicative of a status is generated when either the expiration date is exceeded or an effectively usable period expires.

52. An ink cartridge management method for an ink cartridge having a storage system storing data defining a fixed expiration date since the ink cartridge was manufactured and data defining an effectively usable period having a variable expiration date, wherein the effectively usable period corresponds to a quality of the ink; and wherein a signal indicative of a status in generated when either the expiration date Is exceeded or an effectively usable period expires.

* * * * *